US007905280B2

(12) United States Patent
Mills

(10) Patent No.: US 7,905,280 B2
(45) Date of Patent: Mar. 15, 2011

(54) SELF ADJUSTING DEBRIS EXCLUDER SUB

(75) Inventor: Aubrey C. Mills, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 175 days.

(21) Appl. No.: 12/030,005

(22) Filed: Feb. 12, 2008

(65) Prior Publication Data

US 2009/0200030 A1 Aug. 13, 2009

(51) Int. Cl.
*E21B 33/12* (2006.01)

(52) U.S. Cl. ..... 166/202; 166/99; 166/387; 277/335; 277/337; 277/339

(58) Field of Classification Search ..... 166/99, 166/202, 387; 277/335, 337, 339
See application file for complete search history.

(56) References Cited

U.S. PATENT DOCUMENTS

| | | | | |
|---|---|---|---|---|
| 1,749,033 | A * | 3/1930 | Fisher | 277/339 |
| 2,335,025 | A * | 11/1943 | Reed | 277/335 |
| 2,855,051 | A * | 10/1958 | Holloway | 166/118 |
| 4,284,137 | A * | 8/1981 | Taylor | 166/137 |

OTHER PUBLICATIONS

Fraija, Jose, et al.; "New Aspects of Multilateral Well Construction"; Oilfield Review; Autumn 2002; pp. 52-69.
Lougheide, Delano, et al.; "Trinidad's First Multilateral Well Successfully Integrates Horizontal Openhole Gravel Packs"; OTC16244; Offshore Technology Conference; Houston, TX; May 3-6, 2004; 16 pgs.
Fipke, Steven, et al.; "A New TAML Level 3 Multilateral System Improves Capabilities and Operational Efficiences"; IADC/SPE 74496; IADC/SPE Drilling Conference; Dallas, TX; Feb. 26-28, 2002; 10 pgs.

* cited by examiner

*Primary Examiner* — Giovanna C Wright
(74) *Attorney, Agent, or Firm* — Cantor Colburn LLP

(57) ABSTRACT

A self adjusting excluder sub includes a first subassembly; a second subassembly with respect to which the first subassembly is axially movable; and a support disposed at the second subassembly and when actuated being resiliently disposed against the first subassembly while being laterally movable relative to the first and second subassemblies jointly and method.

19 Claims, 1 Drawing Sheet

SELF ADJUSTING DEBRIS EXCLUDER SUB

BACKGROUND

Whipstocks are well known to the hydrocarbon industry as devices providing a hardened diverter face useful to cause a milling tool run into the downhole environment either behind (single trip) or after (multiple trips) the whipstock to track through a wall of a borehole whether that hole be cased or open. The ability to cause such "side tracks" is important in that it is the basis for multilateral wellbore technology. Multilateral technology has dramatically enhanced the ability of operators to recover hydrocarbon materials from subsurface formations by accessing multiple reservoir areas from a single surface location. This reduces the cost involved with recovering the hydrocarbon materials and in addition, reduces the footprint of a well system at the surface.

Inherent in the milling of either a casing or the formation or both is the production of debris. Debris in the wellbore is undesirable because it tends to cause malfunctions in well equipment resulting in delays and additional costs in running the well operation. In order to avoid debris falling down the wellbore, debris barrier devices have been employed by the industry. Unfortunately, an effective debris barrier has eluded the art.

SUMMARY

A self adjusting debris excluder sub includes a cup; a cone configured to bias the cup to a sealed position; and a support having an end supporting the cup and an end mounted in the sub to allow lateral movement of the end that supports the cup.

A self adjusting excluder sub includes a first subassembly; a second subassembly with respect to which the first subassembly is axially movable; and a support disposed at the second subassembly and when actuated being resiliently disposed against the first subassembly while being laterally movable relative to the first and second subassemblies jointly.

A debris excluder includes a cup having a first perimetrical dimension smaller than a tubular member in which it is intended to be run; and a cone in operable communication with the cup to selectively increase the cup to a second perimetrical dimension.

A method for milling a window while excluding debris includes shifting a second subassembly relative to a first subassembly in a self adjusting excluder sub; and expanding a cup of the first subassembly with a cone of the second subassembly, the cone mounted on a support articulated from the second assembly.

BRIEF DESCRIPTION OF THE DRAWINGS

Referring now to the drawings wherein like elements are numbered alike in the several Figures.

DETAILED DESCRIPTION

Figure 1:
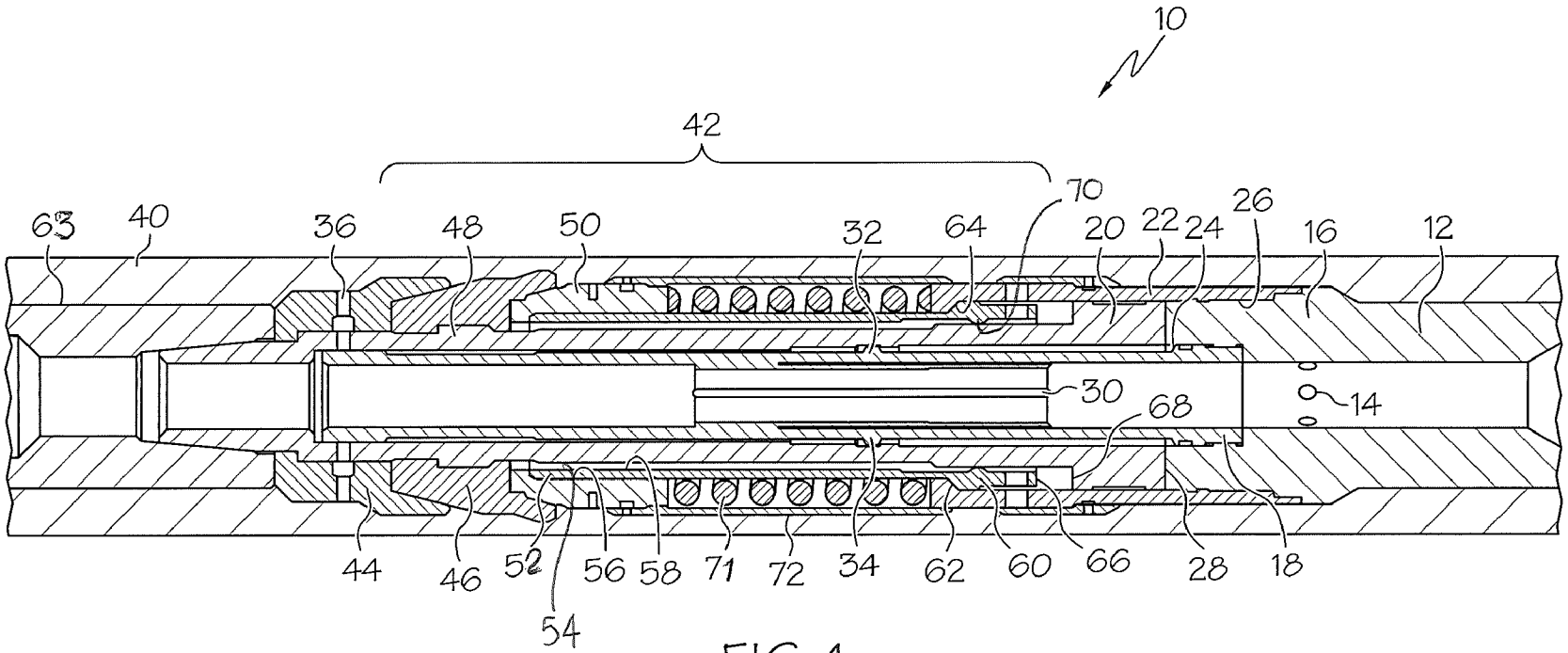
FIG. 1 is a cross-sectional view of a debris catcher for use with a whipstock as disclosed herein.

It has been discovered by the inventors hereof that whipstock debris catchers of the prior art have been thwarted by properties inherent in the whipstock assembly. Because whipstock assemblies are pushed to a side of the primary borehole in which they are anchored opposite of the side of the borehole at which an exit is being milled by the milling tool, debris excluding devices of the prior art can fail to catch all the debris. Further, because the greatest concentration of debris is generated on the side of the whipstock that is being pushed away from the borehole wall, generally, therefore also being the side of the whipstock where a prior art debris catcher is most vulnerable, debris generally escapes capture.

Referring to FIG. 1, a debris catcher arrangement 10 is illustrated that accommodates the lateral movement of the whipstock inherent in milling the casing or open hole wall. The arrangement 10 includes a bottom sub 12 that is configured to be received in an anchor of the prior art (not shown). The bottom sub 12 includes at least one, and as shown, a series of ports 14 to prevent a swabbing effect of the tool as it is tripped into or out of the hole. A downhole end of the bottom sub 12 is, as noted above, configured for receipt by a conventional anchor (not shown) in the wellbore. This, then, is also the pivot point about which the arrangement 10 and a whipstock (not shown) attached thereto (at a top sub introduced later herein) pivot when the whipstock is urged laterally during a milling operation as discussed above. The bottom sub 12 is attached at an uphole end 16 thereof to each of a collet 18, a mandrel 20 and a spring retainer 22. The collet and the spring retainer are fixedly attached to the bottom sub 12 at affixation 24 and 26, respectively, while the mandrel 20 is axially slidably received at the bottom sub 12. A torque transmissive coupling 28 is provided between the mandrel and the bottom sub for two specific reasons. The first is to allow torque generated as a byproduct of the milling operation to be borne through the arrangement to the anchor (not shown) so that the whipstock (not shown) will remain in the orientation in which it is intended to exist. The second is to provide a stroke length that is designed into the tool and ensures that a fluid bypass closing operation (discussed more fully hereunder) takes place reliably. In one embodiment, the stroke length is about 1.5 inches although it is to be appreciated that other lengths can be designed in for particular applications.

The collet 18 cooperates with the mandrel 20 through a resiliency of the collet occasioned by one or more slits 30 therein, a series of slits 30 being illustrated. The collet 18 includes a profile 32 thereon complementarily shaped to a recess 34 in the mandrel 20. The profile 32 is disposed downhole of the recess 34 during run in and prior to actuation of the debris seal arrangement 10 and resides in the recess 34 after such actuation. It is to be appreciated that it is the mandrel that moves downhole rather than the collet moving uphole during actuation. The collet 18 is axially fixed. In one embodiment, the collet 18 is configured to provide a deflection force of about 20,000 pounds. This means that the collet can be snapped in for actuation and snapped out for deactivation of the arrangement 10 by using a set down weight of about 20,000 or a pull of about 20,000 pounds. Other amounts of force can be designed in. In the embodiment discussed, this rating is selected to be between the typical setting range of about 12,000 to about 15,000 pounds for the anchor (not shown) and about 40,000 pounds for the milling bit to whipstock release member (not shown but well known commercially available configuration). This will ensure that the arrangement 10 actuates at the appropriate time. In addition, it is to be appreciated that the collet as disclosed herein, in combination with the other components, disclosed results in an arrangement that does not utilize one time release members such as shear screws thereby enabling the arrangement to be snapped in/snapped out numerous times if necessary or desired for some reason. Debris excluding configurations of the prior art do not possess such capability.

Consequent movement of the mandrel 20, at least one opening 36 or a series of openings 36 as illustrated, are blocked during the actuation phase of the arrangement 10.

The openings 36 are necessary to allow fluid to flow from an annular area of the wellbore 40 through the arrangement 10 and through ports 14 back to the annular area when the arrangement is being run in or retrieved from the hole, a fluid bypass arrangement. After the arrangement 10 is landed in the anchor (not shown), blocking the openings 36 closes a potential debris path. In order to ensure that the bypass is closed, the stroke of the mandrel must be a substantially fixed dimension. As noted above, in one embodiment, the length is 1.5 inches. Were the arrangement 10 to stop stroking the mandrel 20 prior to achieving the full design stroke (of for example 1.5 inches), the blocking of the bypass might well be ineffective leading to potential migration of debris through the arrangement 10. As this would be contrary to the point of the arrangement 10, it is undesirable. Therefore, it is important to achieve a full stroke. Potentially impeding the gratification of full stroke, however, is the relative unknown of the casing or open hole inside dimension. If the debris excluding arrangement encounters resistance to the stroke due to contact with the casing or open hole wall, the full stroke can be in jeopardy. To alleviate this potential occurrence, resiliency in the arrangement is also provided (discussed further hereunder).

Also, consequent movement of mandrel 20, a debris catch system 42 of the arrangement 10, is actuated. The debris catch system 10 comprises a cup thimble 44 (through which openings 36 extend) fixedly attached to the mandrel 20. A cup 46 is nested within the cup thimble 44 and further anchored to the mandrel at shoulder 48. Cup 46 may be constructed of a number of different materials providing they have a debris exclusionary effect. Materials include but are not limited to a resilient material such as rubber or plastic, a wire brush comprising metal or other material capable of withstanding the environment in which it is intended to be deployed, etc. The material is to act as a debris catch with the casing or open hole wall to exclude debris from falling downhole of the arrangement 10 when actuated. In one embodiment as illustrated, the cup 46 is a frustoconical structure that grows in diametrical dimension in a downhole direction. This provides an advantage for retrieval of the arrangement 10 because debris cannot collect in the concavity defined by the frustocone. Such debris would interfere with dimensional reduction of the cup 46 when retrieving the arrangement 10, an undesirable occurrence. Prior to actuation (including during run in) the system 42 is a clearance fit within the borehole so that the cup 46 does not experience significant wear during the run in and so that the tool avoids "float" in the bore related to too small of an annular space around the cup 46 for fluid to easily pass during the run in.

Once the arrangement 10 is in place in the borehole, it is actuated whereby the cup 46 is radially displaced, to effect a debris catch. Displacement in one embodiment is by a cone 50. The cone 50 is fixedly mounted upon a support 52, for example, a sleeve as illustrated, which is itself disposed about the mandrel 20 but not in contact therewith. The cone 50 acts as a wedge against the cup 46 to cause the cup 46 to grow in outside dimension. The sleeve 52 is axially moveably mounted about the mandrel 20 with a clearance annulus 54. Clearance annulus 54 is disposed between an inside dimension surface 56 of the sleeve 52 and an outside dimension surface 58 of the mandrel 20. This annulus, provided within the arrangement 10, is important in that it allows the cone 50 to remain relatively centralized in the borehole even when the whipstock (not shown) is urged off center thereby causing the arrangement 10 to pivot about the anchor point at a downhole end of the bottom sub 12. The centralized position of the cone causes the cup 46 to be pushed into contact with the wall of the casing or open hole even though the whipstock is out of center. Because of the arrangement 10, debris exclusion is enhanced. In one embodiment, the cone 50 is mounted at one axial end of the sleeve while the other axial end of the sleeve is mounted to the mandrel 20 allowing the end of the sleeve supporting the cone to move laterally relative to the arrangement 10.

Further to the foregoing, the sleeve 52 includes at a downhole end thereof a radially thickened section 60 with a stop surface 62. The stop surface 62 is cooperable with a stop flange 64. Sleeve 52 further includes an end 66 that is limited in movement by a shoulder 68 of mandrel 20. Total axial movement of the sleeve 52 and therefore cone 50 is limited to the illustrated distance between end 66 and shoulder 68. Promoting articulation of the sleeve 52 about its thickened section 60 is a ridge 70 which spaces the thickened section 60 of the sleeve from the mandrel 20 providing an articulation point.

The cone 50 is biased by a resilient member 71, such as a spring, as illustrated. The resilient member 71 is protected by a cover 72. The bias drives the cone into the cup 46 in order to expand the same when the sleeve 52 is driven in a downhole direction by the movement of the arrangement 10. Further, the member 71 serves another purpose for the arrangement 10 and that is to allow resiliency in the system 42 when the cup 46 contacts the borehole wall prior to the mandrel fully stroking the designed in distance. For example then, assuming the cup 46 contacts the borehole wall early in the stroke of the mandrel, the mandrel will not be prevented from achieving a full stroke because the member 71 deflects to facilitate full stroke of the mandrel. In other words, because after the cup 46 contacts the borehole wall, the cone cannot significantly more move into cup 46, something has to give or the mandrel will stop its stroke. What gives in the illustrated embodiment is the member 71 to allow the rest of the stroke to occur. It is to further be appreciated that while no seal is shown at the bypass, one could easily be created by providing seals such as o-rings on the collet straddling the openings 36. Because the arrangement is primarily a debris catcher, sealing is unnecessary. It is well to note, however, the sealing potential of the arrangement 10 if needed for a particular application.

Initial downhole movement of the arrangement comprises a downhole motion of a first sub assembly of the arrangement 10 comprising the mandrel 20, cup 46, cup thimble 44, a top sub 63 (all of which are fixed relative to each other) and other components (not shown) attached uphole of the components illustrated relative to a second subassembly comprising the bottom sub 12, the collet 18, the spring retainer 22, the sleeve 52, the cone 50 and the resilient member 71. When the mandrel moves downhole, the collet 18 deflects and moves the profile 32 into the recess 34. Due to the retainer 22 being fixedly attached to bottom sub 12, the resilient member 71 cannot move downhole but rather is compressed axially both facilitating stroke for the mandrel 20, as noted above and resulting in a rebound force that is used to force the cup 46 to open. The rebound force facilitates the maintenance of the cup 46 in a position to effectively exclude debris even when the arrangement 10 is pivoted out of position due to the whipstock being urged off center into a wall of the borehole opposite the exit window being milled.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A self adjusting debris excluder sub for a borehole comprising:

a cup;

a cone configured to bias the cup to a sealed position; and a support having an end supporting the cone and an end mounted in the sub to allow lateral movement of the end that supports the cone relative to a longitudinal extent of the sub, maintaining the cone relatively centralized in the borehole even if the sub is urged off center of the borehole.

2. The self adjusting excluder sub as claimed in claim 1 wherein the cup is constructed of a resilient material.

3. The self adjusting excluder sub as claimed in claim 1 further comprising an annulus defined by one or more surfaces of the support and a surface spaced therefrom to allow for the lateral movement of the support.

4. The self adjusting excluder sub as claimed in claim 1 further comprising a resilient member biasing the cone into contact with the cup.

5. The self adjusting excluder sub as claimed in claim 4 wherein the resilient member is a spring.

6. The self adjusting excluder sub as claimed in claim 1 wherein the support is a sleeve.

7. A self adjusting excluder sub comprising:

a first subassembly;

a second subassembly with respect to which the first subassembly is axially movable; and a support disposed at the second subassembly and when actuated being resiliently disposed against the first subassembly while being laterally movable relative to the first and second subassemblies jointly to maintain a centralized position of the support even if the sub is urged off center.

8. The self adjusting excluder sub as claimed in claim 7 wherein the support includes a stop surface that is interactive with a stop flange of the second assembly.

9. The self adjusting excluder sub as claimed in claim 7 wherein the support is articulated within the sub.

10. The self adjusting excluder sub as claimed in claim 7 wherein the sub further includes a cup.

11. The self adjusting excluder sub as claimed in claim 10 wherein the sub further includes a cone in operable communication with the cup, the cone being self adjusting relative to pivotal movement of the first and second subassemblies jointly.

12. The self adjusting excluder sub as claimed in claim 7 wherein the sub further includes a collet configured to allow snap in/snap out operation of the sub.

13. The self adjusting excluder sub as claimed in claim 7 wherein the sub further includes a fluid bypass system allowing for fluid bypass during run in and automatic bypass closure upon actuation of the sub.

14. The self adjusting excluder sub as claimed in claim 13 wherein the fluid bypass system includes a fixed length stroke collet to impede fluid flow through the bypass openings.

15. The self adjusting excluder sub as claimed in claim 14 wherein the collet includes seals to fluid tightly seal the bypass system.

16. A method for excluding debris while milling a window comprising:

shifting a second subassembly relative to a first subassembly in a self adjusting excluder sub; and expanding a cup of the first subassembly with a cone of the second subassembly, the cone mounted on a support articulated from the second assembly such that the support remains relatively centralized even when the sub is urged off center.

17. The method as claimed in claim 16 further comprising automatically self adjusting the cone and support to remain centered in a borehole when the first and second subassemblies pivot in the borehole.

18. The method as claimed in claim 16 further comprising closing a fluid bypass system automatically upon a full stroke of the first subassembly relative to the second subassembly.

19. The self adjusting excluder sub as claimed in claim 1 wherein the sub is a part of a whipstock.

* * * * *